US007600440B2

(12) United States Patent
Bensley et al.

(10) Patent No.: US 7,600,440 B2
(45) Date of Patent: Oct. 13, 2009

(54) AIR DISPLACEMENT APPARATUS FOR USE WITH A FLUID TRANSFER DEVICE

(75) Inventors: Doug Bensley, Ludlow, VT (US); Mark Tanny, Brownsville, VT (US); James Seymour, Claremont, NH (US); Janet Bensley, Ludlow, VT (US)

(73) Assignee: Ivek Corporation, North Springfield, VT (US)

( * ) Notice: Subject to any disclaimer, the term of this patent is extended or adjusted under 35 U.S.C. 154(b) by 534 days.

(21) Appl. No.: 11/113,531

(22) Filed: Apr. 25, 2005

(65) Prior Publication Data

US 2005/0238508 A1 Oct. 27, 2005

Related U.S. Application Data

(60) Provisional application No. 60/565,108, filed on Apr. 23, 2004.

(51) Int. Cl.
*G01N 1/14* (2006.01)

(52) U.S. Cl. ..... 73/864.16

(58) Field of Classification Search ..... 73/864.13, 73/864.16; 92/86.5, 162 R; 277/304
See application file for complete search history.

(56) References Cited

U.S. PATENT DOCUMENTS 2,771,217 A * 11/1956 Brown et al. ..... 73/864.16
2,894,793 A * 7/1959 Robinson ..... 137/155
4,082,121 A * 4/1978 Sturm et al. ..... 141/27
4,671,123 A * 6/1987 Magnussen et al. ..... 73/864.16
4,779,467 A * 10/1988 Rainin et al. ..... 422/100
5,921,554 A * 7/1999 Derian et al. ..... 277/516
6,254,832 B1 * 7/2001 Rainin et al. ..... 422/100
6,739,478 B2 5/2004 Bach et al. ..... 222/1

FOREIGN PATENT DOCUMENTS

SU 815531 B * 3/1981

OTHER PUBLICATIONS

Haydon Switch & Instrument, Inc., 28000 Series Size 11 Captive Linear Actuator, 2003.

* cited by examiner

*Primary Examiner*—Hezron Williams
*Assistant Examiner*—Tamiko D Bellamy
(74) *Attorney, Agent, or Firm*—Grossman Tucker Perreault & Pfleger, PLLC

(57) ABSTRACT

A liquid sealed air displacement apparatus may be used in a fluid transfer device to transfer volumes of fluid. The air displacement apparatus may include a piston and a cylinder defining a displacement chamber for receiving the piston. The air displacement apparatus may be used to displace precise volumes of air into the air displacement chamber. Displacing the air creates a negative pressure in the air displacement chamber (i.e., suction), which may cause a precise volume of fluid to be drawn into the fluid transfer device. The piston and the cylinder may define a diametrical clearance for receiving sealing fluid, which may prevent air leakage and wear.

23 Claims, 3 Drawing Sheets

AIR DISPLACEMENT APPARATUS FOR USE WITH A FLUID TRANSFER DEVICE

CROSS-REFERENCE TO RELATED APPLICATIONS

This application claims the benefit of co-pending U.S. Provisional Patent Application Ser. No. 60/565,108, filed on Apr. 23, 2004, which is fully incorporated herein by reference.

TECHNICAL FIELD

The present invention relates to an air displacement apparatus and more particularly, to a liquid sealed air displacement apparatus for use in a fluid transfer device.

BACKGROUND INFORMATION

Fluid transfer devices (e.g., pipette mechanisms) are used to transfer small volumes of fluid in many applications. The devices may range from simple glass tubes to more elaborate mechanical displacement devices. In either case, the devices operate by displacing air and a seal is used to hold the displaced air, which facilitates the liquid transfer. Traditional devices use displacement pistons with mechanical seals such as lip seals or o-rings to prevent the air from entering the displacement chamber. These seals can be run dry, and wear eventually causes the seal to leak air and degrades accuracy of the device.

Accordingly, there is a need for a sealed air displacement apparatus that substantially prevents air leakage and that is capable of running longer without wear or leakage.

BRIEF DESCRIPTION OF THE DRAWINGS

These and other features and advantages will be better understood by reading the following detailed description, taken together with the drawings wherein.

DETAILED DESCRIPTION

Figure 1:
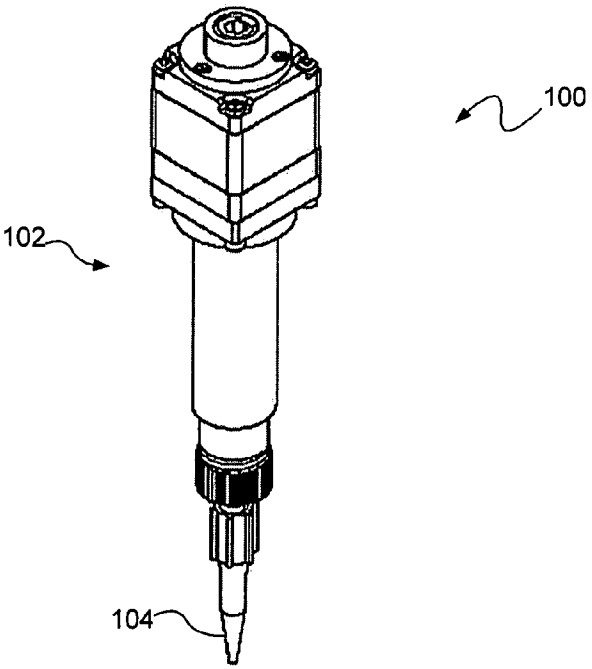
FIG. 1 is a perspective view of a fluid transfer device, consistent with one embodiment of the present invention

Referring to FIG. 1, a fluid transfer device 100, consistent with one embodiment of the present invention, may include a liquid sealed air displacement apparatus 102 and a fluid receiving member 104. The air displacement apparatus 102 may be used to displace precise volumes of air into an air displacement chamber. Displacing the air creates a negative pressure in the air displacement chamber (i.e., suction), which may cause a precise volume of fluid to be drawn into the fluid receiving member 104. The fluid transfer device 100 and/or air displacement apparatus 102 may thus be used in fluid dispensing and metering applications, such as pipetting, aliquoting, and bulk dispensing.

The fluid receiving member 104 may be removably coupled to the air displacement apparatus 102. The fluid receiving member 104 includes a fluid passage or channel that is capable of receiving a volume of fluid and is in communication with the air displacement chamber. Examples of the fluid receiving member 104 include, but are not limited to, a cannula, plastic tubing, a conical pipette tip, or a stainless nozzle. Those skilled in the art will recognize that various types of fluid receiving members may be coupled to the air displacement apparatus 102 for use in various types of applications.

Figure 2:
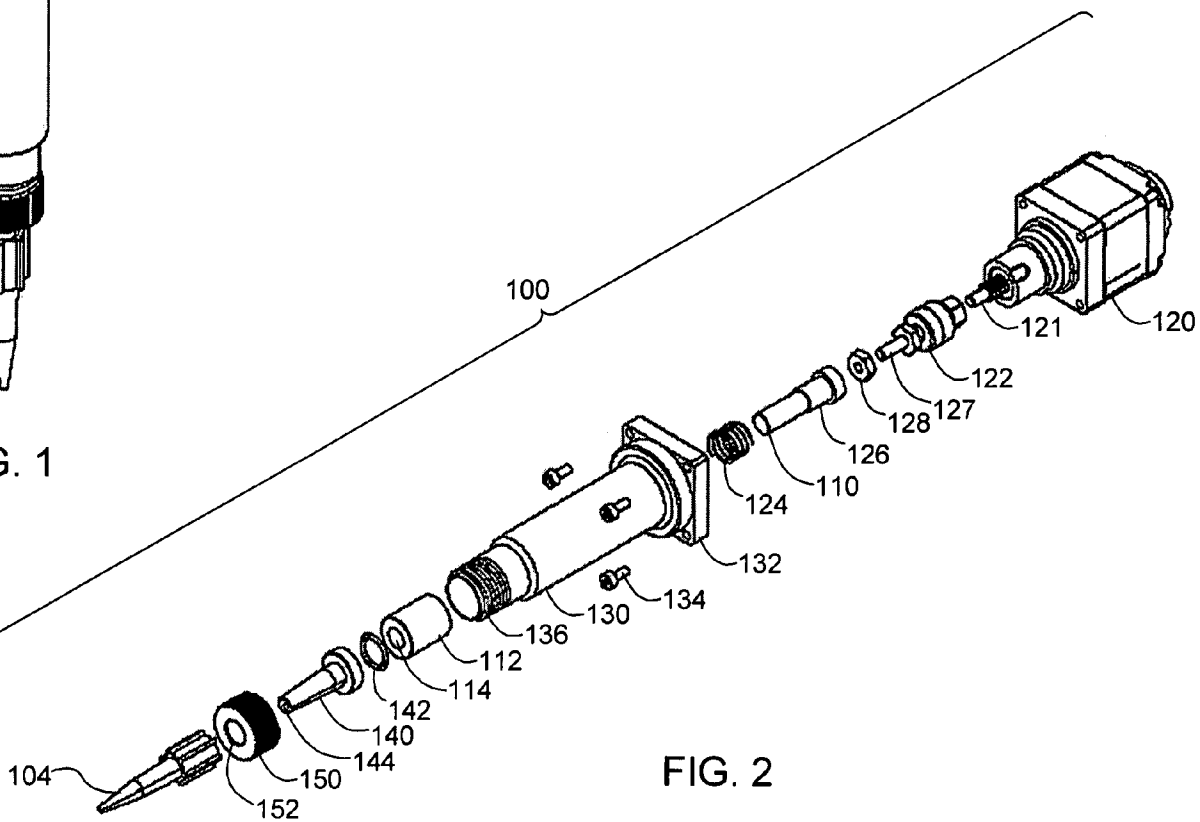
FIG. 2 is an exploded perspective view of the fluid transfer device shown in FIG. 1.
Figure 3:
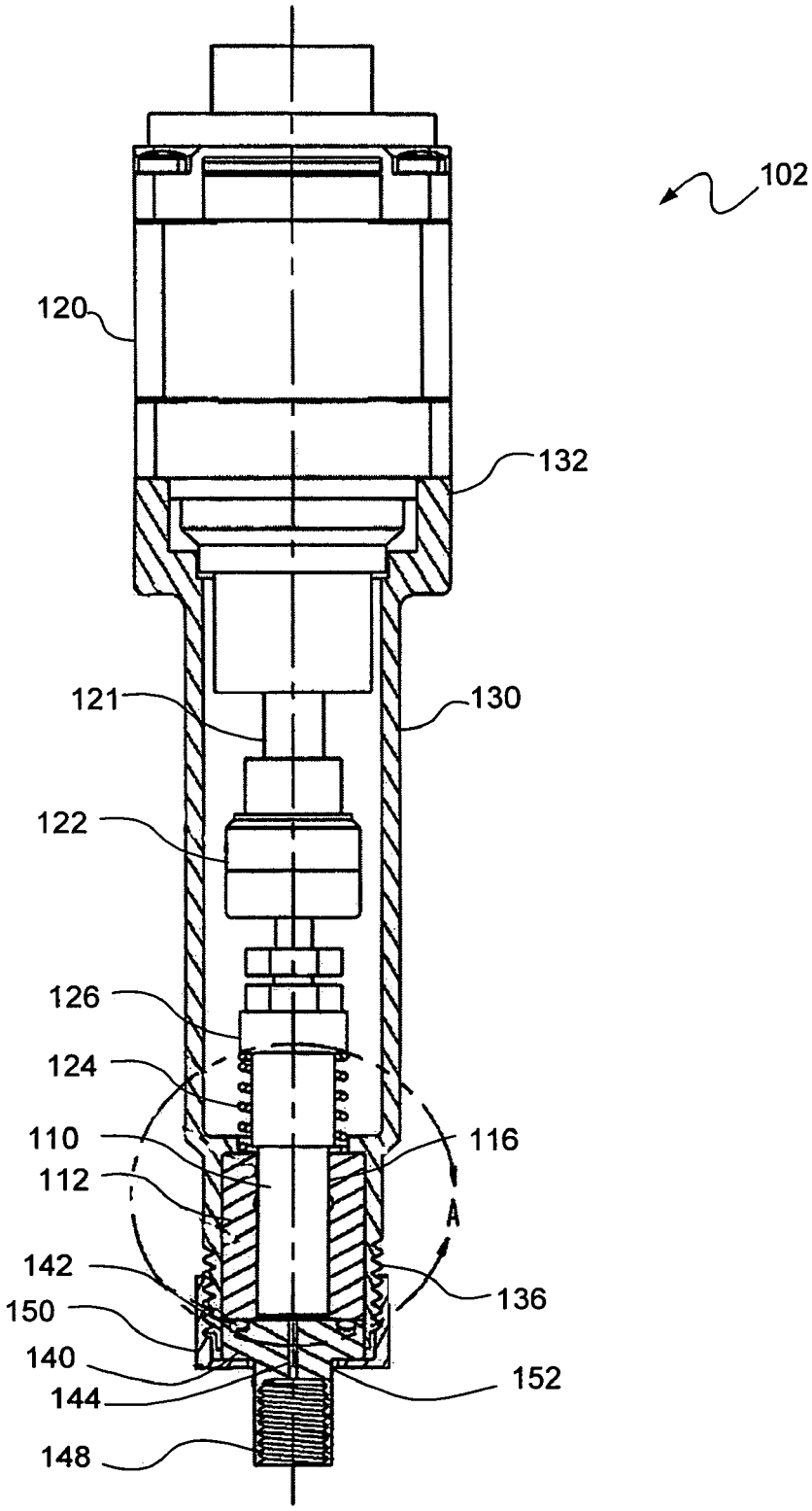
FIG. 3 is a cross-sectional view of a liquid sealed air displacement apparatus that may be used in a fluid transfer device, consistent with one embodiment of the present invention.

Referring to FIGS. 2 and 3, one embodiment of the air displacement apparatus 102 includes a piston 110 and a cylinder 112 receiving the piston 110. The cylinder 112 defines an air displacement chamber 114, and the piston 110 causes displacement of air when the piston 110 retracts from the displacement chamber in the cylinder 112. The piston 110 and the cylinder 112 may define a close clearance 116 configured to receive a sealing fluid. The clearance 116 may be configured with a dimension to maintain the sealing fluid between the piston 110 and the cylinder 112. In other words, the tight fit of the piston 110 and the cylinder 112 substantially prevents the sealing fluid from leaking out. The total diametrical clearance 116 may be in a range of about 50 to 500 millionths of an inch and more specifically approximately 100 millionths of an inch. One embodiment of the piston 110 and the cylinder 112 may be made of a ceramic material such as alumina or zirconia ceramic.

The sealing fluid in the clearance 116 between the piston 110 and the cylinder 112 prevents air from entering the displacement chamber 114 formed when the piston 110 is retracted. The sealing fluid may be a silicone oil or other similar fluid. Those skilled in the art will recognize other types of sealing fluid that are capable of sealing the clearance 116 and that are capable of remaining within the clearance 116.

The air displacement apparatus 100 may also include a linear actuator 120 and a coupling 122 between the linear actuator 120 and the piston 110. The coupling 122 may be coupled directly to a drive shaft 121 of the linear actuator 120. The linear actuator 120 may be a lead screw driven captive shaft linear actuator, such as the type available from Hayden Switch & Instrument, Inc. as part no. P28H49-2.1-001. The coupling 122 may be a floating coupling that compensates for angular and lateral misalignment when driving the close clearance ceramic piston/cylinder components.

A compression spring 124 may be positioned against the piston 110 biasing the piston away from the cylinder 120 to compensate for axial backlash, which may be present in the coupling 122 and/or the lead screw in the linear actuator 120. According to one embodiment, the piston 110 may include a piston cap 126 having at least two diameters. The spring 124 may be captured between the piston cap 126 and the cylinder 112 such that the spring 124 is under compression (e.g., approx. 2 lbs.) when the piston 110 is fully inserted into the cylinder 112. The piston cap 126 may be made of metal and may be attached to the piston 110 by interference fit, adhesive bonding, or other mechanical fastener. The coupling 122 may be coupled to the piston cap 126 using a threaded stud 127 and lock-nut 128.

A housing 130 may be coupled to the linear actuator 120 and may enclose at least the piston 110, the cylinder 112, the coupling 122, and the spring 124. The linear actuator 120 may be coupled to one end 132 of the housing 130, for example, using fasteners 134. The cylinder 112 may be rigidly mounted within the other end 136 of the housing 130. The piston 110 and the coupling 122 may be located within the housing 130 in a manner that allows the piston 110 and the coupling 122 to move axially within the housing 130. Although the housing 130 is shown as generally cylindrical, the housing may have other shapes and configurations.

A port fitting connector 140 may be located at the other end 136 of the housing 130, for example, adjacent to the cylinder 112. The end of the cylinder 112 may be sealed with a static o-ring 142 held against the port fitting connector 140. The port fitting connector 140 may include a port passage 144 that provides fluid communication between the displacement chamber 114 and the fluid passage in the fluid receiving member 104. The fluid receiving member 104 may be coupled to the port fitting connector 140, for example, using a commercially available gas tight fitting. One exemplary embodiment of the port fitting connector 140 may include a ¼-28 flat bottom boss 148, although a wide variety of fluid connections may be used. The port fitting connector 140 may allow the fluid receiving device 104 to be easily changed without tools. Those skilled in the art will recognize that various types of commercially available or custom-designed port fitting connectors may be used for different applications.

The port fitting connector 140 may be retained against the cylinder 112 with a cap 150 that engages the end 136 of the housing 130. One embodiment of the cap 150 may threadably engage a straight thread on the end 136 of the housing 130. The cap 150 may include a clearance hole 152 in the center such that the port fitting connector 140 protrudes through the clearance hole 152. The cap 150 may thus secure both the port fitting connector 140 and the cylinder 112 to the housing 130.

Figure 4:
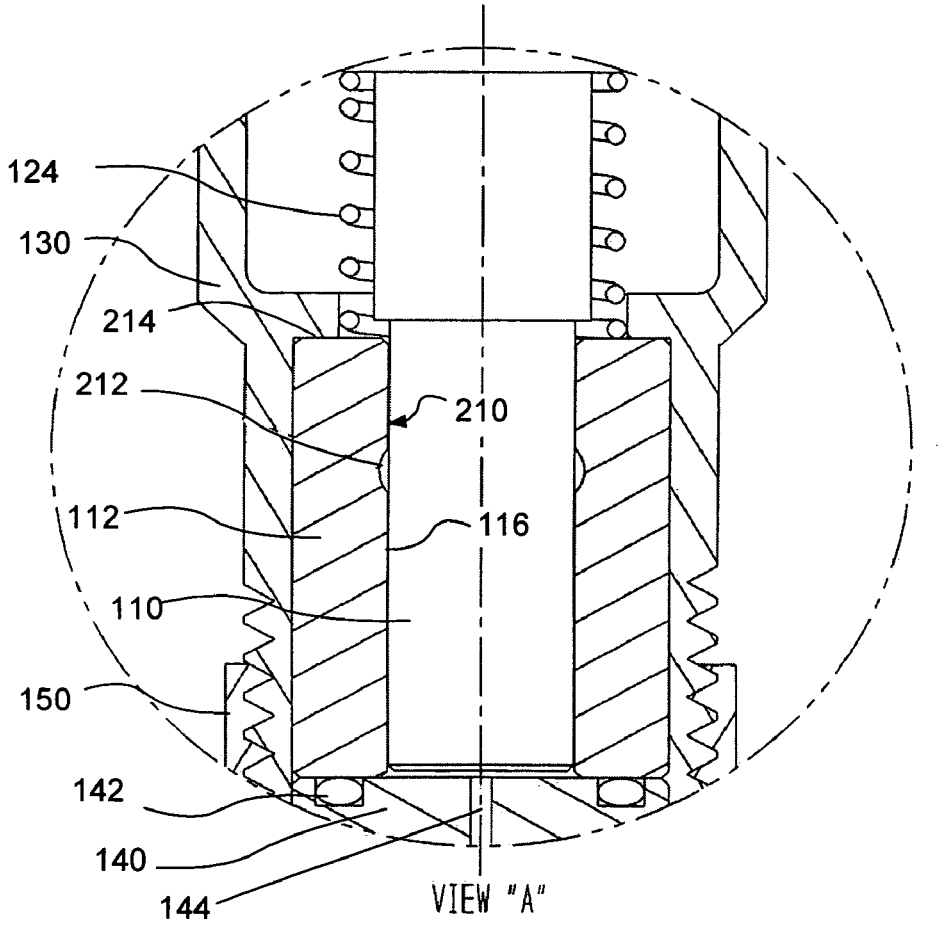
FIG. 4 is an enlarged cross-sectional view of the piston and cylinder arrangement in the liquid sealed air displacement apparatus shown in FIG. 3.

According to one embodiment of the piston and cylinder arrangement, shown in FIG. 4, the cylinder 112 includes an inner wall 210 with an annular groove 212, which serves as a sealing fluid reservoir. The sealing fluid may fill the annular groove 212 as Well as the clearance 116 between the piston 110 and the cylinder 112. The annular groove 212 may be located about 0.125 inches from the end 214 of the cylinder 112 and may have a depth of about 0.012 inches and a width of about 0.062 inches. Alternatively, the cylinder 112 may not include the annular groove 212 and the sealing fluid may only be in the clearance 116.

Figure 5:
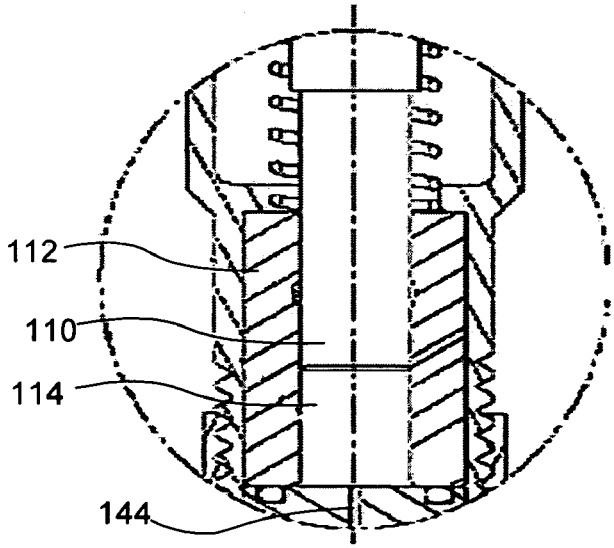
FIG. 5 is an enlarged cross-sectional view of the piston and cylinder arrangement in FIG. 4 forming an air displacement chamber.

One method of operation of the air displacement apparatus is described in reference to FIGS. 4 and 5. As shown in FIG. 4, the piston 110 may be fully inserted into the cylinder 112 without contacting port fitting connector 140. As shown in FIG. 5, the piston 110 may retract from this position to pull air into the displacement chamber 114 through the port passage 144 in the port fitting connector 140. In one embodiment, the piston 110 may be retracted up to about 0.25 in.

In use in a fluid transfer application, the fluid receiving member 104 may be coupled to the port fitting connector 140. The piston 110 usually starts in its fully inserted position (as shown in FIG. 4). The fluid receiving member 104 may then be immersed in the sample fluid. The linear actuator 120 may then retract the piston 110 to create suction and pull a desired amount of fluid into the fluid receiving member 104. When the fluid receiving member 104 is charged with a desired amount of liquid, it may be removed from the sample fluid and relocated to a dispensing target. The linear actuator 120 may then be commanded to index the piston 110 into the cylinder 112 and the sample fluid is dispensed out in part or in whole. Those skilled in the art will recognize that there are many possible operational modes. Those skilled in the art will also recognize that the fluid transfer device 100 may be integrated into automated systems using standard controls.

The movement of the piston 110 may be precisely controlled by the linear actuator 120 to control the volume of fluid that is drawn into the fluid receiving member 104 and the volume of fluid that is dispensed from the fluid receiving member 104. Embodiments of the fluid transfer device 100 may be capable of total volumes in a range of 20 μL to 200 μL and resolutions in a range from 0.02 μL/Full Step to 0.20 μL/Full Step. The exemplary embodiment of the air displacement apparatus 100 is capable of running for millions of cycles without wear or leakage.

Consistent with one aspect of the present invention, a liquid sealed air displacement apparatus includes a linear actuator, a piston coupled to the linear actuator and a cylinder defining a displacement chamber for receiving the piston. The piston causes displacement of air when the piston retracts from the displacement chamber in the cylinder. The piston and the cylinder define a clearance configured to receive a sealing fluid. The clearance is configured with a dimension to substantially maintain the sealing fluid between the piston and the cylinder. The sealing fluid is received in the clearance between the piston and the cylinder and substantially prevents air leakage into the displacement chamber.

Consistent with another aspect of the present invention, a liquid sealed air displacement apparatus includes a linear actuator, a floating coupling coupled to the linear actuator, a piston coupled to the floating coupling, and a cylinder defining a displacement chamber for receiving the piston. The piston causes displacement of air when the cylinder retracts from the displacement chamber in the cylinder. The piston and the cylinder define a clearance configured to receive a sealing fluid, and the clearance is configured with a dimension to substantially maintain the sealing fluid between the piston and the cylinder. The apparatus may also include a compression spring configured to bias the piston away from the cylinder and a port fitting connector coupled to an end of the cylinder. A housing holds at least the linear actuator, the piston, the cylinder, the floating coupling, and the compression spring.

Consistent with a further aspect of the present invention, a fluid transfer device includes a piston configured to be coupled to a linear actuator and a cylinder defining a displacement chamber for receiving the piston. The piston causes displacement of air when the cylinder retracts from the displacement chamber in the cylinder. The piston and the cylinder define a clearance configured to receive a sealing fluid, and the clearance is configured with a dimension to substantially maintain the sealing fluid between the piston and the cylinder. The sealing fluid is received in the clearance between the piston and the cylinder to substantially prevent air leakage into the displacement chamber. The fluid transfer device also includes a fluid receiving member coupled to an end of the cylinder. The fluid receiving member includes a fluid passage in communication with the air displacement chamber such that retraction of the piston creates suction in the displacement chamber causing a fluid to be drawn into the fluid passage.

Consistent with yet another aspect of the invention, a liquid sealed air displacement apparatus includes a piston configured to be coupled to a linear actuator and a cylinder defining a displacement chamber for receiving the piston with a clearance between the piston and the cylinder. The piston causes displacement of air when the cylinder retracts from the displacement chamber in the cylinder. The cylinder includes an inner wall defining an annular groove configured to receive a sealing fluid. The clearance and the annular groove are configured with a dimension to substantially maintain the sealing fluid between the piston and the cylinder. The sealing fluid is received in the clearance and the annular groove between the piston and the cylinder to substantially prevent air leakage into the displacement chamber.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A liquid sealed air displacement apparatus comprising:

a linear actuator;

a piston coupled to said linear actuator;

a cylinder defining a displacement chamber for receiving air through one end and for receiving said piston without a mechanical seal sealing against said piston, wherein said piston causes displacement of air into said displacement chamber when said piston retracts from said displacement chamber in said cylinder, said piston and said cylinder defining a diametrical clearance configured to receive a sealing liquid, wherein said diametrical clearance is configured with a dimension to substantially maintain said sealing liquid between said piston and said cylinder; and a sealing liquid received in said diametrical clearance between said piston and said cylinder, wherein said sealing liquid substantially prevents air leakage into said displacement chamber.

2. The apparatus of claim 1 wherein at least one of said piston and said cylinder define a sealing liquid reservoir configured to receive said sealing liquid.

3. The apparatus of claim 1 wherein said cylinder includes a wall defining an annular groove for receiving said sealing liquid.

4. The apparatus of claim 1 wherein said diametrical clearance is in a range of about 50 to 500 millionths of an inch.

5. The apparatus of claim 1 wherein said clearance is about 100 millionths of an inch.

6. The apparatus of claim 1 further comprising a floating coupling between said linear actuator and said piston.

7. The apparatus of claim 1 further comprising a compression spring configured to bias said piston away from said cylinder.

8. The apparatus of claim 1 further comprising a housing holding at least said piston and said cylinder.

9. The apparatus of claim 1 further comprising a port fitting connector coupled to an end of said cylinder.

10. The apparatus of claim 9 further comprising a cap retaining said port fitting connector.

11. A liquid sealed air displacement apparatus comprising:

a linear actuator;

a floating coupling coupled to said linear actuator;

a piston coupled to said floating coupling;

a cylinder defining a displacement chamber for receiving said piston, wherein said piston causes displacement of air when said piston retracts from said displacement chamber in said cylinder, said piston and said cylinder defining a diametrical clearance configured to receive a sealing liquid, wherein said diametrical clearance is configured with a dimension to substantially maintain said sealing liquid between said piston and said cylinder;

a compression spring configured to bias said piston away from said cylinder;

a port fitting connector coupled to an end of said cylinder; and a housing holding at least said linear actuator, said piston, said cylinder, said floating coupling, and said compression spring.

12. The apparatus of claim 11 wherein at least one of said piston and said cylinder define a sealing fluid reservoir configured to receive said sealing fluid.

13. The apparatus of claim 11 wherein said cylinder includes a wall defining an annular groove for receiving said sealing fluid.

14. The apparatus of claim 13 further comprising a sealing fluid received in said annular groove and in said diametrical clearance between said piston and said cylinder, wherein said sealing fluid prevents air from entering said displacement chamber.

15. A fluid transfer device comprising:

a piston configured to be coupled to a linear actuator;

a cylinder defining a displacement chamber for receiving said piston, wherein said piston causes displacement of air into said displacement chamber when said piston retracts from said displacement chamber in said cylinder, said piston and said cylinder defining a diametrical clearance configured to receive a sealing liquid, wherein said diametrical clearance is configured with a dimension to substantially maintain said sealing liquid between said piston and said cylinder, wherein said cylinder includes a wall defining an annular groove for receiving said sealing liquid;

a sealing liquid received in said diametrical clearance between said piston and said cylinder, wherein said sealing liquid substantially prevents air leakage into said displacement chamber; and a fluid receiving member coupled to an end of said cylinder, wherein said fluid receiving member includes a fluid passage in communication with said air displacement chamber such that retraction of said piston creates suction in said displacement chamber causing a fluid to be drawn into said fluid passage.

16. The fluid transfer device of claim 15 wherein said fluid receiving member is selected from the group consisting of a cannula and a pipette.

17. The fluid transfer device of claim 15 further comprising a port fitting connector coupling said cylinder to said fluid passage member.

18. The fluid transfer device of claim 15 further comprising a housing holding said cylinder and said piston.

19. The fluid transfer device of claim 15 further comprising a compression spring configured to bias said piston away from said cylinder.

20. The fluid transfer device of claim 15 further comprising a floating coupling coupled between said piston and a linear actuator.

21. A liquid sealed air displacement apparatus comprising:

a piston configured to be coupled to a linear actuator;

a cylinder defining a displacement chamber for receiving said piston without a mechanical seal sealing against said piston and with a diametrical clearance between said piston and said cylinder, wherein said piston causes displacement of air into said displacement chamber when said piston retracts from said displacement chamber in said cylinder, said cylinder including an inner wall defining an annular groove configured to receive a sealing liquid, wherein said diametrical clearance and said annular groove are configured with a dimension to substantially maintain said sealing liquid between said piston and said cylinder; and a sealing liquid received in said diametrical clearance and said annular groove between said piston and said cylinder, wherein said sealing liquid substantially prevents air leakage into said displacement chamber.

22. The apparatus of claim 21 wherein said diametrical clearance is in a range of about 50 to 500 millionths of an inch.

23. The apparatus of claim 21 further comprising a linear actuator, a floating coupling between said linear actuator and said piston, and a compression spring configured to bias said piston away from said cylinder.

* * * * *